US005879511A

United States Patent [19]

Ågren

[11] Patent Number: 5,879,511

[45] Date of Patent: Mar. 9, 1999

[54] RECOVERY BOILER OPERATION WITH BLACK LIQUOR FEED IN SEPARATE LIQUID STREAM AND SOLID STREAM

[75] Inventor: Erik Ågren, The Regalia, Singapore

[73] Assignee: Ahlstrom Machinery OY, Karhula, Finland

[21] Appl. No.: 889,014

[22] Filed: Jul. 7, 1997

[30] Foreign Application Priority Data

Jul. 5, 1996 [FI] Finland ..... 962758

[51] Int. Cl.[6] ..... D21C 11/12

[52] U.S. Cl. ..... 162/30.1; 162/30.11

[58] Field of Search ..... 162/19, 29, 30.1, 162/30.11, 33

[56] References Cited

U.S. PATENT DOCUMENTS

| | | | |
|---|---|---|---|
| 4,054,636 | 10/1977 | Menig | 264/250 |
| 4,135,968 | 1/1979 | Dehaas | 162/30 R |
| 4,363,698 | 12/1982 | Nelson et al. | 162/30.1 |
| 5,143,579 | 9/1992 | Field et al. | 162/30.1 |
| 5,230,773 | 7/1993 | Petanen | 159/47.3 |

FOREIGN PATENT DOCUMENTS

| | | |
|---|---|---|
| 119215 | 6/1940 | Sweden . |
| WO 90/02838 | 3/1990 | WIPO . |

OTHER PUBLICATIONS

Trobeck, The BT–System for Soda and Heat Recovery in Sulphate Pulp Mills, *Paper Trade Journal*, No. 16, Apr. 1950.

*Primary Examiner*—Stanley S. Silverman
*Assistant Examiner*—Dean T. Nguyen
*Attorney, Agent, or Firm*—Nixon & Vanderhye P.C.

[57] ABSTRACT

The present invention relates to a method of improving the operation of a boiler plant in a chemical pulp mill. At least part of the black liquor flow of the chemical pulp mill is divided into several batches being substantially in a solid form, which are mechanically turned into substantially equal-sized pieces for deeding into the recovery boiler and for combustion taking place therein. Waste liquor batches may be stored prior to the combustion. The invention also relates to a system for carrying out the method.

20 Claims, 3 Drawing Sheets

RECOVERY BOILER OPERATION WITH BLACK LIQUOR FEED IN SEPARATE LIQUID STREAM AND SOLID STREAM

BACKGROUND AND SUMMARY OF THE INVENTION

The present invention relates to a method of improving the operation of a boiler plant of a chemical pulp mill, when black liquor is fed into the furnace of a recovery boiler to be cumbusted together with air in order to recover energy and chemicals from the liquor. The invention also relates to an arrangement for carrying out the method.

When combusting waste liquor in pulp processes, the aim is to separate the organic and inorganic substances of the dry matter in the waste liquor from each other. The heat obtained from the organic part of the dry matter is recovered and by means of this heat as much steam as possible is generated. Process chemicals are recovered from the inorganic part of the dry matter in such a form that they may in later stages of the process be turned into a suitable form to be reused in the cooking process.

Soda recovery boilers have so far proved superior in recovering heat and chemicals from waste liquor. A recovery boiler may be considered to have three different stages prior to the actual heat-absorbing parts: a drying zone in which the liquor is fired, a reduction stage at the bottom, and an oxidation stage at the upper part. The waste liquor is injected as drops into the furnace of the boiler. A stoichiometric amount of air, corresponding to the amount of the waste liquor, and excess air to ensure complete combustion are fed into the soda recovery boiler. The combustion air is fed through several air feed openings, usually either from all four walls of the boiler or from two opposite walls only. In order to ensure complete combustion, the air is usually fed at three different levels: the primary air at the bottom of the furnace, the secondary air above the primary air level but below the liquor nozzles, and the tertiary air above the liquor nozzles. In addition, there may also be other air levels, for example above the tertiary air level, whereby the aim is, for example, to reduce the amount of nitrogen oxides from combustion.

In the hot combustion chamber, the water, the volatile components of the dry matter as well as the gasifiable components vaporize from the liquor drops. The gases ignite, bringing heat to the heat transfer surfaces within the boiler, to the furnace, and to the boiler tube system. The combustion gases are removed from the upper part of the boiler. The ash of the waste liquor drops, i.e. the inorganic substances of the waste liquor, are gathered onto the bottom of the boiler, forming a so called bed, from which they are removed and subsequently pasted through the different stages of the process back to the cooking process.

Since the chemical reactions in a soda recovery boiler take place very rapidly, the rate of the process becomes totally dependent upon the mixing of combustion air and waste liquor. The mixing and the mass transfer determine the rate of combustion and also affect the efficiency of the process. On the other hand, in order to carry out efficient recovery of the chemicals, the inorganic material and the carbon required for reduction have to be taken to the bed at the bottom of the boiler. The air and the black liquor are fed into the boiler from separate nozzles, whereby it is vitally important to achieve a uniform gas flow and proper missing into the furnace. The symmetry of combustion must be monitored all over the cross-section of the boiler and the feed of air must be controlled when the need arises.

The black liquor is usually fed into the soda recovery boiler as relatively large drops so that the drops would pass downward but would not pass as fine fume together with the upward-flowing gases to the upper part of the boiler. The drops passing upward would cause fouling of the boiler and increase the circulating dust flow.

In a soda recovery boiler, it is particularly non-uniform or inefficient feed of the air, especially of the secondary air, that leads to a poor combustion result, clogging of the heat transfer surfaces and an increase in the emissions of the flue gases. The feed of the secondary air has to be controlled in such a way that the components vaporizing and gasifying from the black liquor are mixed as well as possible into the combustion air and will not discharge from the boiler without having been combusted, which would weaken the efficiency of the combustion. Furthermore, the components which get carried away in the flue gas flow tend to foul heat transfer surfaces in the heat recovery apparatus downstream of the boiler. The components discharging from the boiler also increase the emissions. It has been observed that especially in a boiler having a large diameter and a furnace with an area of about 10 m×10 m or more, the penetration of air into the middle portions of the boiler is difficult to control. Moreover, it has been observed that air flows introduced at right angles relative to each other at corners of a quadrangular boiler have a tendency to partly inhibit the penetration of each other into the boiler.

The mixing of liquor and air is further impeded by an upward-flowing gas flow generated in the middle portion of the boiler, as it is difficult for a weak air flow to penetrate into it. The air flows having been introduced from the sides at the lower portion of the boiler tend to bump against each other in the middle portion of the boiler and form there a gas flow which passes very rapidly upward, drawing with it from the lower portion of the furnace gaseous and dusty substances having been combusted incompletely. Moreover, the gas flow, also called a "drop elevator", pulls with it small downward-flowing black liquor drops which it encounters and brings them to the upper part of the boiler, where they stick to heat transfer surfaces, causing fouling and clogging. The velocity of the gas flowing upward from the middle parts may even quadruple compared to the average velocity of gases. An area of a rapid flow is thus formed in the middle portion of the boiler, and it is very difficult to achieve mixing of combustion air into the flow from the side thereof.

Thus, it is especially important from the point of view of the stable operation of the soda recovery boiler that the behaviour of the liquor drops in the rising gas flow and the flowing of the gases as such can be controlled as well as possible. The behaviour of the liquor drops is greatly affected by the dry matter content of the liquor. Previously, the black liquor has been combusted at a dry matter content of 63–75%. It is advisable to remove as much water as possible from the black liquor prior to feeding it into the recovery furnace, as the vaporization of the water still present in the black liquor cools the furnace and slows down the combustion process. Current solutions enable the concentration of the black liquor into a significantly higher dry matter content (i.e. 75–90%), which brings about significant advantages in the combustion of the black liquor. The liquor drops having a high dry matter content combust more rapidly and closer to the liquor nozzles. Such drops also dry more rapidly and with a smaller amount of heat. The liquor nozzles may be mounted at a sharper angle downward, whereby the carryover of the liquor drops is decreased. However, the known methods for producing liquor drops do not produce one-sized drops only, but, in addition to the desired size, also too large and too small drops, whereby it is not possible to avoid the carryover entirely. Increasing the dry matter content also increases the temperature in the lower portion of the furnace, whereby the sulphur dioxide emissions in the soda recovery boiler are decreased and the reduction in the bed is increased. The flow of combustion air and the way of feeding thereof, for example air distribution between different air levels, remain substantially unaffected by the increase in the dry-matter of the liquor.

Nevertheless, treating black liquor at a high dry matter content does cause problems. The viscosity of the black liquor is increased exponentially as the dry matter content increases. In order to overcome the resistance caused by the viscosity, the black liquor needs to be evaporated and transferred into the recovery boiler at a high temperature and under pressure. The storage tank of black liquor has to be pressurized, at least if the dry matter content of the black liquor is over 75%. The pressurized process apparatus is technically demanding and risky, being also an expensive solution.

Black liquor at a high dry matter content also tends to foul and clog heat transfer surfaces and tubes, which must therefore be cleaned often. This, in turn, leads to process shut-downs and requires expensive spare equipment. The feed of this kind of liquor as equal-sized drops into the furnace is also often problematic. Achieving a uniform feed is, on the other hand, an essential factor in maintaining stable combustion in the furnace.

A few methods have previously been provided for feeding black liquor as dry as possible into the recovery boiler.

In U.S. Pat. No. 4,347,698, a method is provided according to which sawdust is mixed into blackliquor concentrated in part, and the mixture is dried with hot air prior to the feeding into the boiler.

It has also been suggested that water be evaporated from black liquor by mixing the black liquor previously concentrated by known evaporating methods into the superheated steam under pressure. The generated vapor is removed, heated and returned to the process. The water content of the black liquor having been dropped to 0–20% by this treatment, the black liquor is removed from the apparatus via a nozzle. Hereby, as the pressure is decreased, the remaining water evaporates, and a dry and non-sticky particulate substance is obtained which may be combusted in a furnace. A method like this has been described in Swedish patent publication no. 119215.

WO publication 90/02838, in turn, describes a method, in which chemical melt from the recovery furnace is used for evaporation of water from partly concentrated black liquor (the dry matter content being 60–80%). The black liquor is dried preferably to a dry matter content of about 100%, whereby a dry, non-sticky particulate substance is obtained, which substance may then be fed together with the combustion air flow into the recovery boiler.

An object of the present invention is to provide a method better than the prior art methods for improving the operation of a boiler plant in a chemical pulp mill. In particular, an object of the invention is to achieve a method of improving the control of the combustion of black liquor, whereby the black liquor at a high dry matter content can be fed into the furnace of a boiler uniformly and regularly without the combustion in the furnace being interrupted. Furthermore, an object is to provide a method which does not substantially increase the consumption of energy at a boiler plant. An object is also to avoid expensive auxiliary equipment or spare devices and storage tanks which would be needed during possible process interruptions and shut-downs.

In order to achieve the above-described objects it is essential for the present invention that at least part of the black liquor flow of the chemical pulp mill is turned into batches having a substantially solid form, which are mechanically turned into substantially equal-sized pieces for the introduction into the recovery boiler and the combustion taking place therein.

The invention also relates to an apparatus arrangement, the characteristic features of which are described in the appended claims.

The basic idea of the invention is that black liquor is not fed into the boiler in a pumpable form and as drops, but instead, the liquor having been concentrated at the evaporation plant is continuously divided into portions of given sizes, i.e. batches. When forming the portions, the black liquor may be either in a pumpable or solid form, but the resulting portions are substantially solid, at least at the final stage. Portions like this may thus be turned immediately or in a desired period of time into pieces of suitable sizes for combustion. In order to improve the control of the combustion the pieces have to be as equal-sized as possible. They must not be too small, because in such a case they would get mixed into the upward-flowing gas and would thus foul heat transfer surfaces. On the other hand, large pieces disturb the proceeding of the combustion The diameter of the pieces is preferably about 3–50 mm, and most preferably about 5–10 mm, whereby the weight of one piece is about 10–100 mg on average.

Prior to the division thereof, the liquor is treated in manners known as such. Most preferably, the black liquor is concentrated to a dry matter content of over 80%, most preferably of 85–95%, because the forming of solid batches is hereby easiest. It is also essential that the black liquor to be combusted should contain as little water as possible.

According to a preferred embodiment, the black liquor is evaporated firstly into the dry matter content of over 80%, preferably into the dry matter content of 85–95%. The black liquor is expanded and subsequently divided into several batches, which are cooled. The substantially solid liquor batches obtained hereby are treated so that they have suitable sizes and are in a suitable form for the introduction into the recovery boiler and the combustion.

By means of existing concentration apparatus it is possible to achieve a dry matter content of 85–95% more easily then before by using high pressure and temperature (e.g. 2 bar, 150° C.). A preferred method and apparatus are disclosed in U.S. patent application 08/500,012 filed on Jul. 10, 1995, now U.S. Pat. No. 5,716,496 (the disclosure of which is hereby incorporated by reference herein), for example. The viscosity of the black liquor may be lowered by heat treatment during the evaporation at a temperature higher than the cooking temperature, as has been described in U.S. Pat. No. 4,929,307 (the disclosure of which is hereby incorporated by reference herein).

At least part of the black liquor coming from the evaporation plant and having been evaporated to a high dry matter content in the concentrator is treated by the method according to the invention and therefore expanded in order to lower the pressure and the temperature of the liquor, whereas the rest of the black liquor flow is led into a recovery boiler in a conventional way. Alternatively, the whole of the black liquor flow may be treated according to the invention, this being the most preferable way, so that it becomes possible to feed black liquor in the same state into the recovery boiler. In the expansion, the dry matter content of the black liquor rises to some extent. The black liquor at a high dry matter content (85–95%) gets solid while cooling and is pasty already at atmospheric pressure and at a temperature of about 130° C. The outcoming black liquor is packed into vessels of suitable sizes, such as cases and barrels. The volume of the vessel may be 2 $m^3$, for example. The size of the vessels has to be chosen in such a way that there will be no special problems in treating the vessels.

As regards the packing material, a suitable material may be used which is advantageous for both the process and the environment and which can be combusted together with the black liquor in the recovery boiler without causing an increase in emissions or in so called dead load of the boiler. A wood fiber-based material, such as cardboard, is suitable for this purpose. The packing vessels may, however, also be so called recirculation vessels, for example plastic or metal barrels. The use thereof is less advantageous, though, since they require auxiliary equipment, by means of which the black liquor is removed mechanically out of the vessel.

The packing vessel is supported, as black liquor is introduced into it. After the filling, the vessel is closed and transferred for cooling into suitable dry storage space, such as to the courtyard of the plant. The vessel must be covered sufficiently, for example by a tarpaulin. Within a few hours, the black liquor will have hardened, so that the black liquor vessels may be transferred and piled upon each other without having to be especially careful.

In order that black liquor in the packages may be combusted in the boiler, the size and form of the packages have to be made suitable for the introduction into the boiler. This may preferably be done in such a way that both the combustible packing material and the solid black liquor to be combusted are fed into a device like a screw mixer, where it is pressed into a paste bar. From this bar, slices or pieces of different sizes are cut by means of a disk disintegrator, for example, for introduction into the recovery boiler. Hereby, the combustion in the boiler is improved, as solid, fairly equal-sized pieces of combustible matter are guided thereto.

According to another preferred embodiment of the invention, the black liquor batches are formed by covering them with a suitable material instead of packing them into a vessel. The black liquor batches may preferably be formed by dosing liquor into a material flow generated by the recycling of the products of petrochemistry or forest industry so as to coat the liquor batches with the material. Material flows applicable for the purpose are for example slurry generated in the recycling, packing waste and waste plastics. A particular material flow may be used on the condition that the combustion of that material does not disturb the operation of the boiler.

Black liquor is dosed into the flow of coating material in batches the size of which is such that the treatment, the possible cooling and modifying of the batches will not be adversely affected.

What makes a most suitable coating material is the ash separated from the flue gases of the recovery boiler. Usually, this ash is returned to the boiler by mixing it into the black liquor to be fed into the boiler. By coating the black liquor batches with ash it is possible to make the returning of the ash uniform and easier.

By means of the above-described method according to the invention it is possible in a simple way to control the feed of the fuel of a recovery boiler, i.e. the feed of black liquor. The method enables a uniform feed with substantially equal-sized pieces. It is possible to design the air system of a recovery boiler simpler and more cost-effective, as there is no longer need to construct it with the most important consideration being that the liquor drops would dry and pyrolyze prior to getting into the bed and would not be carried away into the rising flue gas flow. Thanks to the decrease in the carryover, the heat transfer surfaces do not clog as easily as before and the need for soot steam is decreased. The rise in the dry matter content of the liquor—so that it is ensured that the dry matter content is constantly high—decreases fouling of the downstream heat surfaces of the boiler and offers an opportunity to construct the surfaces in a more cost-effective way as is now possible. As there will be no in flight combustion any longer, the reduction is improved and the amount of circulating salts is decreased, and at the same time, the nitrogen oxide emissions are decreased. The method according to the invention also has a positive impact on TRS and $SO_2$ emissions, meaning that they are also decreased, although these emissions do not cause problems in a modern soda recovery boiler from the point of view of the combustion process itself.

By means of the method according to the invention it is possible to store black liquor even for long times. The liquor may usually be stored in a dry open storage area. If the relative humidity is very high (for example over 90%), the storage has to be done in the presence of an inert gas (for example nitrogen) in order to prevent the black liquor batches from becoming wet. The possibility of storing is an important advantage of the invention, since in many occasions there is a need for storing of black liquor. The recovery boiler may be stopped without stopping other processes, such as the production line of pulp, at the chemical pulp mill. The liquor from the evaporation plant is merely dry-stocked. On the other hand, before taking the pulp line into use, it is possible to use the dry stock. It is also possible to transport the liquor in a solid form from one mill to another.

Storage tanks have always been a bottleneck in expanding pulp mills. The method according to the invention enables almost limitless storing of black liquor in the middle of the most critical process stage and makes small and even slightly more demanding changes at fiber and recovery lines possible. For example, an evaporation plant could be stopped for the period within which the wash takes place and only stored black liquor could be combusted in the recovery boiler. Hereby, there would be no need for spare equipment, which are normally used during the wash. When applying the method according to the invention in a conventional situation, both solid and pumpable black liquor are combusted in the recovery boiler.

Although the invention was described above in connection with sulphate black liquor, the method is also applicable to other waste liquors coming from the chemical pulp industry and having similar properties as sulphate black liquor.

BRIEF DESCRIPTION OF THE DRAWINGS

The invention is described in more detail with reference to the appended drawings, of which

DETAILED DESCRIPTION OF THE DRAWINGS

Figure 1:
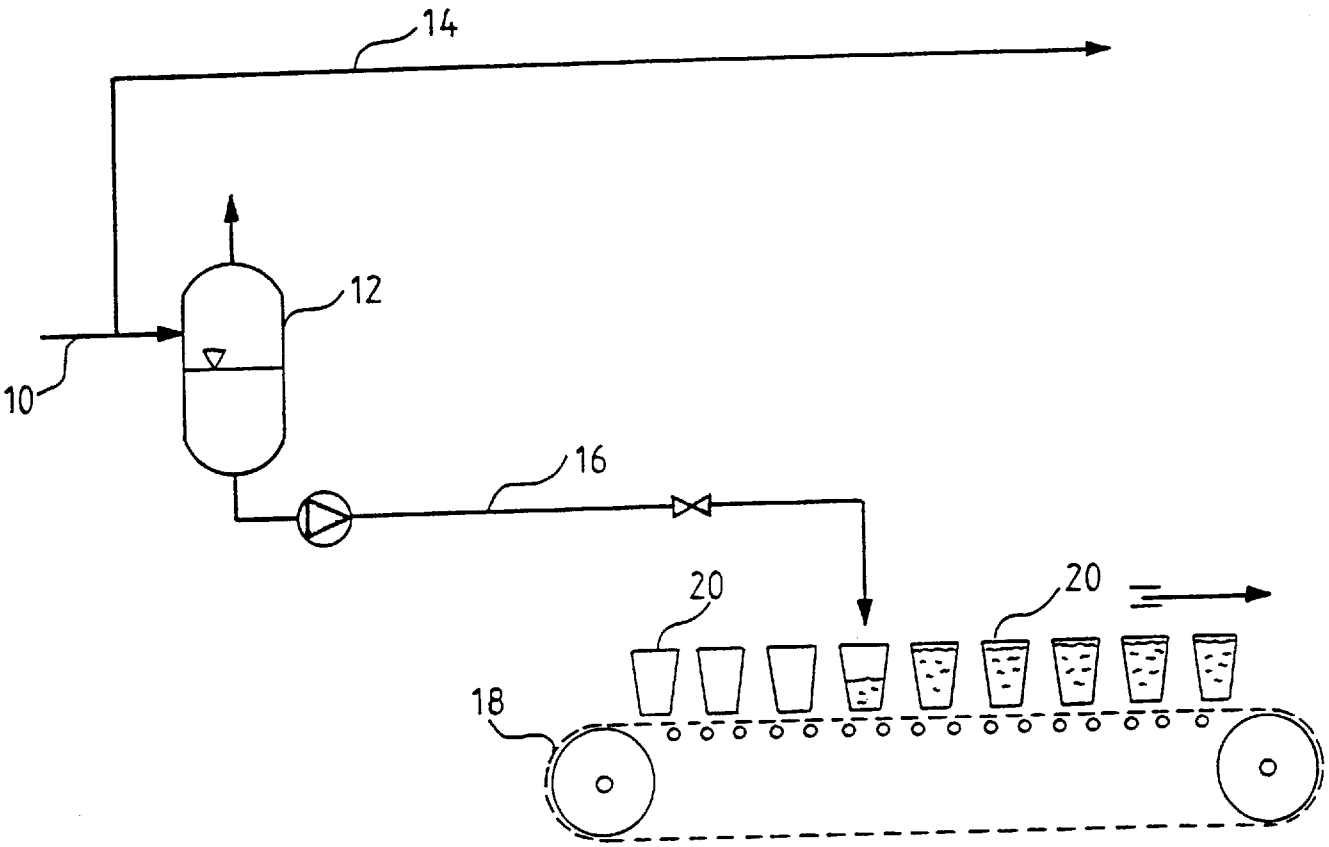
FIG. 1 illustrates an embodiment of the present invention, in which black liquor is divided into batches.

The black liquor is introduced from the evaporation plant through a line 10 at a dry matter content of over 80% and at a high pressure and temperature into a flash tank 12. Part of the black liquor is fed in a manner known as such along a line 14 directly into the recovery boiler to be combusted. In the flash tank 12, the black liquor is expanded to atmospheric pressure. The expanded black liquor is subsequently transferred along a line 16 to be distributed in suitable-sized batches into vessels 20 on a conveyer 18. There will be no significant amounts of vapors being separated after the expansion.

Figure 2:
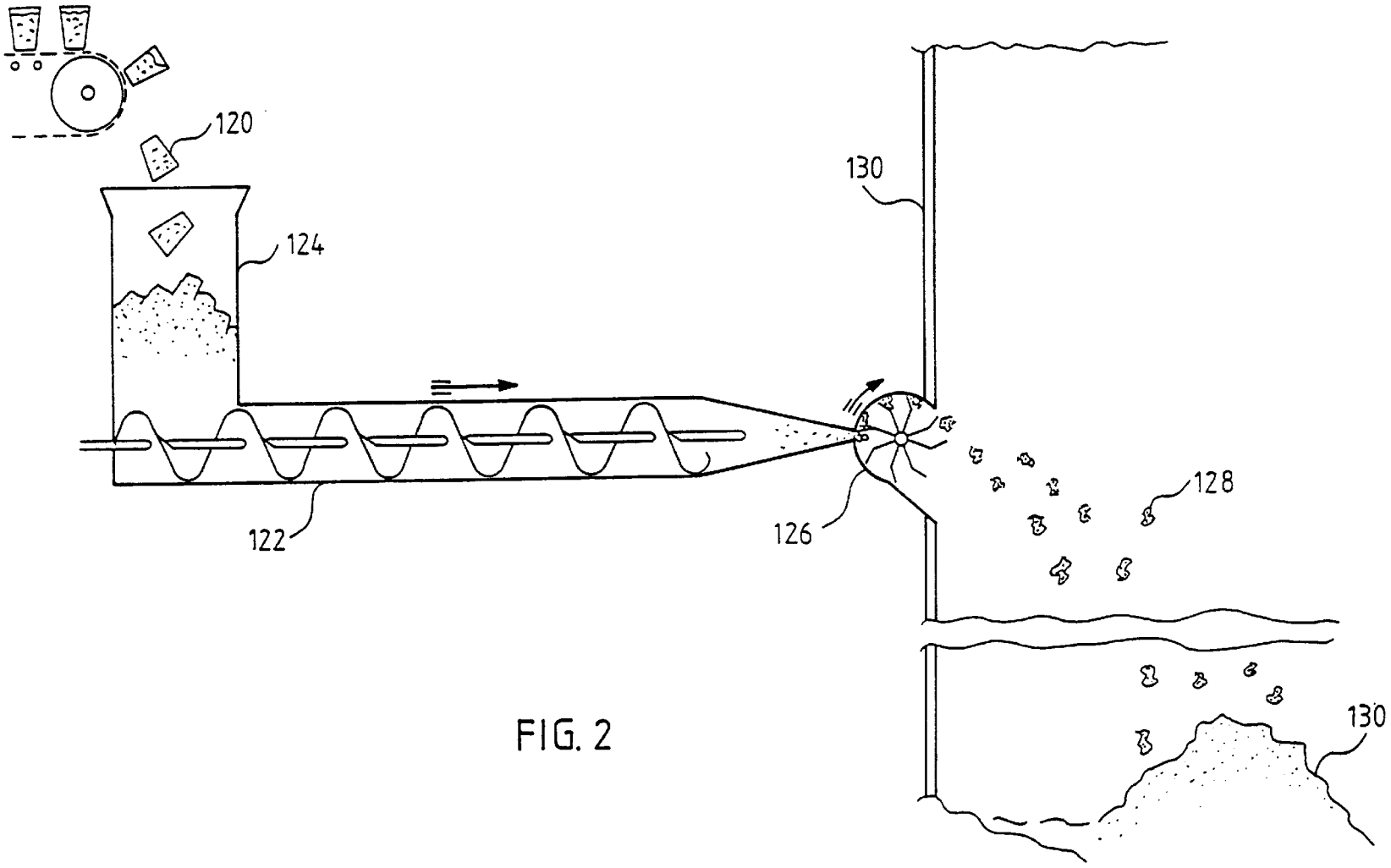
FIG. 2 illustrates feeding of black liquor batches according to FIG. 1 into a recovery boiler.

The liquor vessels are taken to suitable storage space to cool into a solid form. When it is desirable to combust black liquor in the storage area, the black liquor vessels 20 are brought into a feed hopper 124 of the screw mixer 122, as shown in FIG. 2. Instead of a screw mixer, any other device known as such may be used, by means of which the black liquor batch may be turned into a uniform paste. In the screw, the packing vessels with their liquor are pressed into a paste bar, which is cut in a disk disintegrator 126 or the like apparatus into suitable-sized slices or pieces 128 for combustion, which slices or pieces are fed into a recovery boiler 130. The pieces 128 drop into a bed 130 on the bottom of the boiler, where the organic matter combusts and the inorganic matter melts at a high temperature.

Figure 3:
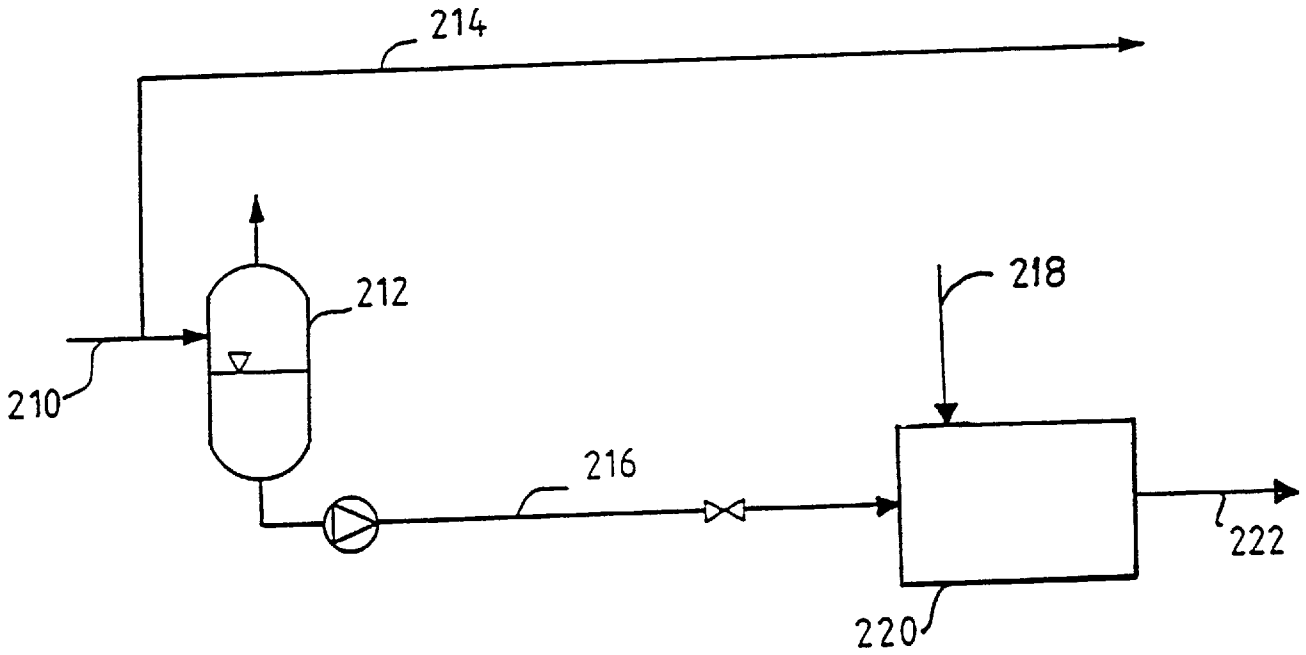
FIG. 3 illustrates a second embodiment of the present invention, in which black liquor is divided into batches.

In FIG. 3, as correspondingly in FIG. 1, the black liquor is brought from the evaporation plant through a line 210 at a dry matter content of over 80% and at a high pressure and temperature into the flash tank 212. Part of the black liquor is fed in a manner known as such along a line 214 directly to the recovery boiler to be combusted. In the flash tank 212, the black liquor is expanded to atmospheric pressure. The expanded black liquor is subsequently transferred along a line 216 to be divided into suitable-sized batches. The liquor is dosed from the line 216 into a mixing device 220, for example to a drum, whereto also ash is introduced from the ash hoppers (not shown) of the recovery boiler along the line 218. In the mixing apparatus, each black liquor batch is coated with ash. The black liquor batches coated with ash may be stored, if desired, or fed immediately to the recovery boiler, whereby they are treated in the way corresponding to that described in connection with FIG. 2, in other words they are taken through a line 222 into an apparatus like a screw mixer described in FIG. 2.

The present invention brings about important benefits for the operation of a chemical pulp mill:

- the control of the operation of the recovery boiler is facilitated;
- there is an almost limitless possibility of storing black liquor at the critical point of the process (between the evaporation plant and recovery boiler) without expensive storage tanks;
- the disturbancies in the process can be eliminated without stopping departments, which naturally increases production and the stability thereof;
- improvements and repairs of process apparatus can be carried out without stopping several departments, which naturally helps to ensure stable production;
- a possibility is created to safely handle black liquor at a high dry matter content;
- black liquor may be transferred under atmospheric pressure;
- even at a simpler, i.e. more cost-effective, evaporation plant, where rapid fouling of the heat transfer surfaces with the rise of the dry matter content of the black liquor is a problem, the evaporator may be run periodically, i.e. the surfaces may be washed more often, and thus said high dry matter content as well as most of said benefits may be achieved by applying this method;
- the dry matter content of the boiler does not vary significantly but must be maintained almost stable, as the liquor is in a solid form. Hereby, the deposits in the boiler may be detached more easily than if there was variation in the dry matter content of the black liquor to be fed;
- there is no need for additional equipment for washing at the evaporation plant; and
- the transportation of the liquor even to another mill becomes possible.

I claim:

1. A method of improving the operation of a boiler plant of a chemical pulp mill having a recovery boiler furnace, and a black liquor stream, comprising:

(a) mechanically transforming at least part of the black liquor stream into substantially equal-size substantially solid pieces; and (b) feeding the substantially solid pieces, and any remaining liquid portion of the black liquor stream, into the recovery boiler furnace to effect combustion thereof.

2. A method as recited in claim 1 wherein (a) is practiced by dosing the black liquor into vessels made of a material which combusts in the recovery boiler furnace.

3. A method as recited in claim 2 wherein (a) is practiced by forming a paste bar comprising black liquor and the combustible vessels, and cutting the paste bar into substantially equal-size pieces.

4. A method as recited in claim 3 wherein (a) is further practiced by passing the black liquor and combustible vessels into a screw mixer to form a paste bar, which is cut into pieces by a disk disintegrator adjacent a discharge from the mixer.

5. A method as recited in claim 4 wherein (b) is practiced by discharging directly from the disk disintegrator into the recovery boiler furnace.

6. A method as recited in claim 4 further comprising evaporating the black liquor before (a) to a dry matter content of between about 85–95%; and wherein (a) is practiced by dividing the black liquor with a dry content of between 85–95% into a plurality of batches, and cooling the batches, and to produce pieces with a maximum dimension of about 5–10 mm and a weight of between about 10–100 mg.

7. A method as recited in claim 3 wherein (a) is practiced to produce pieces having a maximum dimension of between about 5–10 mm.

8. A method as recited in claim 3 further comprising evaporating the black liquor before (a) to a dry matter content of between about 85–95%; and wherein (a) is practiced by dividing the black liquor with a dry content of between 85–95% into a plurality of batches, and cooling the batches.

9. A method as recited in claim 1 wherein (a) is practiced by forming a paste bar comprising black liquor and packing material, and cutting the paste bar into substantially equal-size pieces.

10. A method as recited in claim 1 wherein (a) is practiced by placing the black liquor into reusable vessels.

11. A method as recited in claim 10 wherein (a) is further practiced by cooling the black liquor in the vessels, and then forming the cooled black liquor into a paste bar, and cutting the paste bar into substantially equal-size pieces.

12. A method as recited in claim 1 wherein (a) is practiced by dosing black liquor into ash separated from the flue gases of the recovery boiler.

13. A method as recited in claim 12 wherein (a) is further practiced by forming a paste bar using the black liquor with ash, and cutting the paste bar into substantially equal-size pieces.

14. A method as recited in claim 13 further comprising evaporating the black liquor before (a) to a dry matter content of between about 85–95%; and wherein (a) is practiced by dividing the black liquor with a dry content of between 85–95% into a plurality of batches, and cooling the batches.

15. A method as recited in claim 1 wherein (a) is practiced by dosing the black liquor into the flow of combustible recycling products of the petrochemistry or forest industries.

16. A method as recited in claim 1 further comprising evaporating the black liquor before (a) to a dry matter content of over 80%; and wherein (a) is practiced by dividing the black liquor with a dry content of over 80% into a plurality of batches, and cooling the batches.

17. A method as recited in claim 16 wherein (a) is practiced to produce pieces having a maximum dimension of between about 5–10 mm.

18. A method as recited in claim 1 wherein (a) is practiced to produce pieces having a maximum dimension of between about 3–50 mm.

19. A method as recited in claim 8 further comprising evaporating the black liquor before (a) to a dry matter content of between about 85–95%; and wherein (a) is practiced by dividing the black liquor with a dry content of between 85–95% into a plurality of batches, and cooling the batches.

20. A method as recited in claim 1 wherein (a) is practiced to produce pieces having a maximum dimension of between about 5–10 mm, and a weight of between about 10–100 mg.

* * * * *